United States Patent [19]

Harnish

[11] Patent Number: 4,558,818

[45] Date of Patent: Dec. 17, 1985

[54] BATCH-TYPE WATER HEATING APPARATUS

[75] Inventor: James R. Harnish, York, Pa.

[73] Assignee: Borg-Warner Corporation, Chicago, Ill.

[21] Appl. No.: 509,760

[22] Filed: Jun. 30, 1983

[51] Int. Cl.[4] ..... F25B 27/02

[52] U.S. Cl. ..... 236/25 R; 62/238.6

[58] Field of Search ..... 237/2 B; 236/20 R, 25 R; 165/29; 62/181, 183, 238.6, 324.4, 324.5; 126/362; 122/4 R; 219/297, 303, 306, 325, 328

[56] References Cited

U.S. PATENT DOCUMENTS

| | | | |
|---|---|---|---|
| 1,698,561 | 1/1929 | Ransom | 122/4 R |
| 4,281,519 | 8/1981 | Spath et al. | 237/19 |
| 4,314,456 | 2/1982 | Harnish | 62/181 |
| 4,363,221 | 12/1982 | Singh | 62/238.6 |
| 4,423,602 | 1/1984 | Venable | 62/238.6 |

*Primary Examiner*—Henry Bennett
*Attorney, Agent, or Firm*—Julian Schachner

[57] ABSTRACT

Batch-type water heating apparatus includes a heat exchanger in which water is heated as it is circulated therethrough, a water storage zone, a flow control device, a water pump, and associated water lines connecting these components to form a closed water circulating loop. Additional water lines associated with the flow control device provide for the withdrawal of heated water from the loop and the addition of make-up water to the loop as water is withdrawn therefrom. The flow control device includes a valve and a thermostat for sensing the water temperature at the outlet of the storage zone. The flow control device is operable to position the valve to facilitate withdrawal of heated water from the loop when the sensed temperature exceeds a predetermined value and to position the valve to facilitate circulation of water around the loop when the sensed temperature is below a predetermined value.

21 Claims, 2 Drawing Figures

BATCH-TYPE WATER HEATING APPARATUS

BACKGROUND OF THE INVENTION

This invention relates generally to water heating apparatus. More particularly, it relates to batch-type water heating apparatus adapted for use in a domestic hot water supply system.

The typical domestic water heater includes a water storage tank and a tank heating unit provided with upper and lower heating devices, generally electric resistance heating elements, respectively associated with upper and lower tank thermostats. The arrangement is such that water in the upper portion of the tank is heated until the upper tank thermostat is satisfied, and then water in the lower portion of the tank is heated until the lower tank thermostat is satisfied. As a result, a limited supply of hot water is replenished in a relatively short period of time, to the extent of the capacity of the upper portion of the tank.

The heat pump has been known for many years. It is generally more costly to purchase initially but more economical to operate than a conventional electric resistance tank heating unit. The heat pump has not been used extensively heretofore because electric power has been relatively inexpensive. As the cost of power increases, there is increasing interest in the use of a heat pump in association with a water heater, especially for providing domestic hot water.

When a heat pump is so used, it is advantageous to make the heat pump responsive to the tank thermostats as an indicator of the demand for hot water. Arrangements of this nature are disclosed to U.S. Pat. No. 4,314,456 issued Feb. 9, 1982, copending U.S. application No. 416,435 filed Sept. 10, 1982, copending U.S. application No. 450,499 filed Dec. 16, 1982 and copending U.S. application No. 497,481 filed May 23, 1983. All are of common assignee herewith, and are incorporated herein by reference.

The U.S. Pat. No. 4,314,456 discloses both a thermostatically operated valve and a by-pass valve. Water leaving the heat pump is maintained at an elevated temperature until the demand in the upper portion of the tank has been satisifed. Thus, much of the time the heat pump is operating at an elevated temperature.

Neither of the two U.S. applications No. 416,435 or 450,499 provides for rapid replenishment of hot water in small batches. Rather, each uses the heat pump to heat an entire tank of water in a single operation.

The U.S. application No. 497,481 provides for replenishment of hot water in portions of the tank. Initially, control means responsive to the upper tank thermostat communicates the upper portion of the tank with the heat pump. Water is circulated from the upper tank portion through the heat pump and back to the upper tank portion until the upper tank thermostat has been satisifed. Subsequently, the control means responds to the lower tank thermostat and communicates the lower tank portion with the heat pump. Water is circulated from the lower tank portion through the heat pump and back to the lower tank portion until the lower tank thermostat has been satisfied. Operation in this manner requires the circulation of water back and forth from the tank to the heat pump.

U.S. Pat. No. 4,363,221 issued Dec. 14, 1982 discloses a water heating system having a heat pump, which system may be operated in either of two modes. In the first mode, an entire tank of water is circulated continuously through the heat pump until the tank thermostat indicates that the desired temperature level has been reached. In the second mode, this circulation is interrupted by a thermostatically controlled valve which is remote from the heat pump. The valve is in effect a throttling valve with a very narrow operating range. Interruption of the circulation introduces operating inefficiencies in the second mode, in that the heat pump operates almost continuously at an elevated temperature. Indeed, it is stated in the patent itself that although rapid recovery of hot water is obtained in the second mode, this is at the expense of thermal efficiency.

There remains a need in the art for batch-type water heating apparatus which will provide for quick recovery; that is, rapid replenishment of the supply of hot water stored in the upper portion of an associated tank. At the same time, the apparatus should be so constructed and arranged that it operates efficiently, is simple, easily constructed and conducive to installation on-site in the field as an adjunct to an existing conventional domestic water heater. Further, it would desirable for the apparatus to be responsive to the tank thermostats as an indicator of the demand for hot water.

SUMMARY OF THE INVENTION

The object of this invention is to meet this need. To that end, there is disclosed batch-type water heating apparatus in the form of a water circulating loop including a water pump, a heat exchanger, a water storage zone, and means for communicating the water circulating loop with the tank of an associated hot water heater. When there is a demand for hot water in the tank, a batch of water is circulated in the loop until it reaches a predetermined temperature, at which time it is diverted to the tank, and make-up water is drawn into the loop.

This batch-type heating process permits the heat pump to operate at lower condensing temperatures when cold make-up water is first added to the loop. Lower condensing temperatures permit higher heat pump capacities and lower power consumption, resulting in a significant improvement in system efficiency. Furthermore, by heating the batch of water to the elevated temperature before returning it to the tank, a quick recovery means is provided for heating the upper portion of the tank. This provides a limited quantity of hot water almost immediately after the tank has been emptied of hot water.

In summary, the batch-type water heating apparatus includes a water circulating loop having a heat exchanger in which water is heated as it is circulated therethrough, a water storage zone, a flow control device, a water pump, and asociated water lines connecting these components. The apparatus also includes means associated with the flow control device providing for the withdrawal of heated water from the loop and the addition of make-up water to the loop as water is withdrawn. The flow control device includes a valve and a thermostat for sensing the water temperature in the loop. The flow control device is operable to position the valve to facilitate withdrawal of heated water from the loop when the sensed temperature exceeds a predetermined value and to position the valve to facilitate circulation of water around the loop when the sensed temperature is below said predetermined value.

BRIEF DESCRIPTION OF THE DRAWING

The objects and advantages of this invention will become apparent to those skilled in the art upon careful consideration of the specification herein, including the drawing, wherein.

DESCRIPTION OF THE PREFERRED EMBODIMENT

Figure 1:
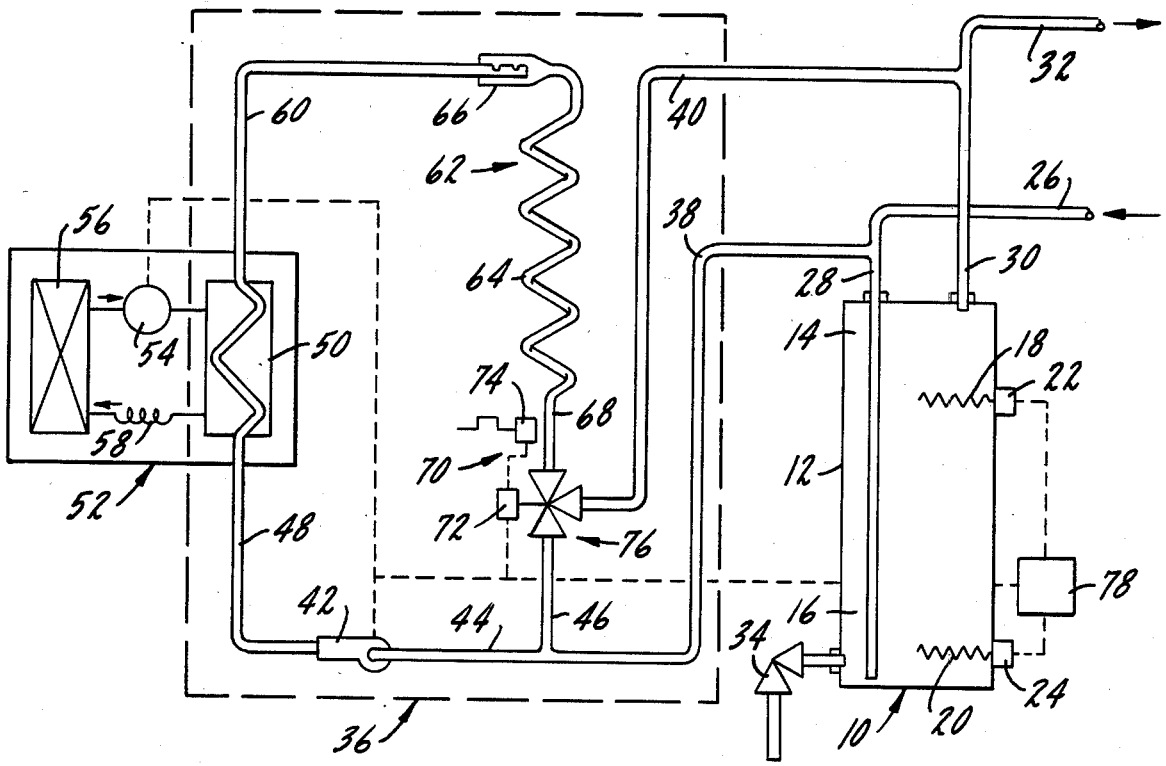
FIG. 1 is a schematic illustration of the batchtype water heating apparatus of this invention.

While this invention may be embodied in many different forms, the preferred embodiment is shown in FIG. 1. It should be understood that the present disclosure is considered to be an exemplification of the principles of the invention, and is not intended to limit the invention to this embodiment.

Turning now to the drawing in greater detail, and to FIG. 1 in particular, reference numeral 10 designates generally a conventional domestic hot water heater. Heater 10 includes a tank 12 with an upper portion 14 and a lower portion 16. Typically upper portion 14 encompasses approximately the upper one-third of tank 12, and lower portion 16 encompasses approximately the lower two-thirds of tank 12. In a conventional manner, tank 12 is provided with a tank heating unit including upper and lower electric heating elements 18 and 20 respectively. Upper and lower tank thermostats 22 and 24 are associated respectively with upper and lower heating elements 18 and 20.

A cold water supply main 26 is connected to a make-up pipe 28 which extends into tank 12 and terminates in lower tank portion 16. A delivery pipe 30 extends from upper tank portion 14 for the supply of hot water to the point of use through a delivery main 32. A drain valve 34 is in communication with lower tank portion 16.

The components shown within the confines of the dashed rectangle designated by reference number 36 generally constitute the batch-type water heating apparatus of this invention. Apparatus 36 includes a water inlet line 38 communicating with make-up pipe 28 and lower tank portion 16. Apparatus 36 also includes a water outlet line 40 communicating with delivery pipe 30 and upper tank portion 14.

Apparatus 36 further includes a water pump 42 or other type of water circulating means. The inlet of pump 42 is in communication with a water line 44 which is connected to line 38 and a water line 46, the latter forming part of a closed water circulating loop to be described below. The outlet of pump 42 is in communication through a water line 48 with the inlet of heat exchanging means 50. In the preferred embodiment of the invention, heat exchanging means 50 is the condenser section of a heat pump 52 or the like. The heat pump includes, in addition to condenser 50, a refrigerant compressor 54, an evaporator 56 and an expansion device 58, all connected in a closed circuit. When the compressor is operating, hot refrigerant gas condenses and heats the water flowing through condenser 50. For a more detailed description of the heat pump operation, reference may be had to the aforementioned U.S. Pat. No. 4,314,456.

The outlet of condenser 50 communicates through a water line 60 with some type of storage device for a significant amount of water (in addition to the amount contained within the water lines), hereinafter referred to as water storage zone 62. In the preferred embodiment of the invention, water storage zone 62 includes a coiled water storage line 64 having a diffuser 66 at its inlet and a water line 68 forming its outlet. Storage line 64 may have a capacity of, for example, about three gallons. In this form, water storage zone 62 occupies a conveniently small space, and is easily handled for installation purposes.

A flow control device 70 includes a three-way valve 72 communicating with outlet 68 of storage line 64, with line 40, and through lines 46 and 44 with water pump 42. Flow control device 70 also includes a temperature sensor 74 which preferably is a thermostat located substantially adjacent outlet 68 of storage line 64 for sensing the water temperature approximately at the outlet of storage line 64 and adjacent valve 72.

In a first position, valve 72 connects outlet 68 with line 46 and blocks line 40. In this position, flow control device 70 forms part of a closed water circulating loop 76 which also includes line 46, line 44, pump 42, line 48, condenser 50, line 60 and storage zone 62. When energized, pump 42 circulates water around this loop. Only enough make-up water to fill loop 76 is drawn from line 38, after which no additional make-up water can be added to the loop.

In a second position, valve 72 connects outlet 68 with line 40 and blocks line 46. In this position, a batch of water approximately equal to the volume of loop 76 is diverted through line 40 to either the point of use through delivery main 32 or, if no water is being drawn from the system at the time, to upper tank portion 14 through pipe 30. It is possible, if only a limited amount of water is being drawn from the system at the time, that some of the hot water from the loop will flow to the point of use via main 32 and the balance to the top of the tank through pipe 30.

When hot water is introduced into upper tank portion 14 as described above, water will be displaced from lower tank portion 16 and will flow upwardly through pipe 28 and through line 38 to make up the water being discharged from loop 76. This water will be cooler than the water which is leaving the loop. Thermostat 74 will sense this condition and reposition valve 72 to facilitate circulation around the closed loop in the heating mode, all as described in more detail below. Some make-up water also may be drawn through inlet line 38 from make-up main 26.

In the preferred embodiment of the invention, valve 72 is under the control of thermostat 74. It assumes its first position in response to a signal from thermostat 74 indicative of a water temperature substantially at the outlet of storage line 64 which is below a predetermined level. This level may be, for example, 140° F. So long as the water temperature is below this level, water is circulated in closed loop 76 and thus through condenser 50. Upon a signal from thermostat 74 that the water temperature is above such predetermined level, valve 72 assumes its second position. Water is diverted to tank 12 (or delivery main 32).

Although the system can be operated without using the standard electric resistance heating elements 18 and/or 20 (already provided in the conventional electric hot water heater), it may be desirable to have the heating elements energized when the heat pump is not able to accommodate the demand for hot water. This contingency may be provided for by suitable control means 78. Control means 78 also may be responsive to thermostats 22 and 24 for controlling pump 42, compressor 54 and control device 70. Details of control means 78 are not critical to this invention. It may be similar to that disclosed in the aforementioned U.S. Pat. No. 4,314,456 or U.S. applications Nos. 416,435, 450,499 and 497,481.

Hot water is delivered to the point of use from tank 12 through delivery main 32 when a user opens one or more taps or valves throughout the area served by the system. Make-up water for tank 12 is received through main 26, which typically would be connected to a suitable cold water source such as the city water supply, and is delivered through pipe 28 to the bottom of tank 12 as needed.

The operating cycle is initiated when upper tank thermostat 22 indicates that there is a demand for hot water in upper tank portion 14. This will occur either when hot water is drawn from upper tank portion 14 through delivery pipe 30, or when the temperature level of water stored in upper tank portion 14 drops to a predetermined level. Assuming that control means 78 is used, it responds to this indication by turning on water pump 42 and compressor 54. Control means 78 also energizes valve 72 so that it assumes its first position, placing outlet 68 in communication with line 46 and blocking line 40. Water circulating loop 76 is closed, and water circulates around this closed loop until thermostat 74 indicates that it has reached a predetermined temperature level. In response to this indication, valve 72 assumes its second position, diverting a batch of heated water from outlet 68 to line 40, thus providing room in loop 76 for make-up water to flow in from line 38. After the loop empties of hot water and fills with cold make-up water, the temperature sensed by thermostat 74 drops, and in response thereto valve 72 again assumes its first position. Another batch of water is circulated around loop 76. Periodically, as indicated by thermostat 74, valve 72 shifts from its first position to its second position, thereby diverting a batch of hot water to line 40.

This operation continues until tank thermostats 22 and 24 indicate that the demand for hot water in tank 12 has been satisfied. Control means 78 responds by turning off water pump 42 and compressor 54, thereby concluding the operating cycle.

It should be apparent that initially the hot water in upper tank portion 14 is replenished in small batches. This arrangement provides quick recovery of a small supply of hot water for domestic use, which supply is determined by the capacity of loop 76.

An important advantage of this invention is that the temperature in condenser 50 is not maintained almost continuously at an elevated level, as would be the case in the arrangements disclosed in the aforementioned U.S. Pat. Nos. 4,314,456 and 4,363,221. Rather, as hot water is replaced by cold water in batches, the average operating temperature within condenser 50 is relatively low. This low condensing temperature contributes to a relatively high system efficiency.

As shown in FIG. 1, the batch-type water heating apparatus of this invention includes inlet line 38, line 44, circulating means 42, line 48, heat exchanging means 50, line 60, storage zone 62, flow control device 70, line 46 and outlet line 40. This portion of the system can be integrated easily with a package heat pump including compressor 54, evaporator 56 and expansion device 58 and installed as a unit as an adjunct to an existing hot water heater. Alternatively, it may be installed "between" an existing heat pump and a water heater, using the heat exchanger of the existing heat pump.

Figure 2:
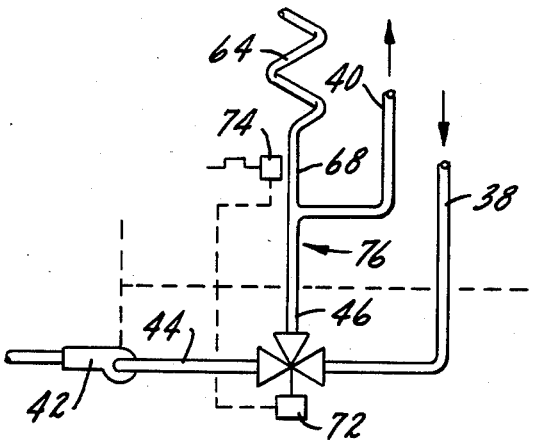
FIG. 2 is a partial schematic illustration, similar to FIG. 1, showing a variation of the batchtype water heating apparatus of this invention.

FIG. 2 shows a modified arrangement which operates in essentially the same manner as the apparatus of FIG. 1, with the same reference numerals being used to designate functionally equivalent components. Valve 72 is responsive to thermostat 74, and assumes a first position connecting line 46 with line 44 and blocking line 38 when thermostat 74 indicates that the water temperature is below a predetermined level. Water is circulated in loop 76 until the temperature increases to a predetermined level, at which time valve 72 assumes its second position connecting line 38 with line 44 and blocking line 46. Make-up water is added to loop 76, and hot water is diverted through line 40 to upper tank portion 14 or delivery main 32.

As shown in FIG. 1, valve 72 facilitates the flow of heated water from loop 76 to outlet line 40, thereby allowing make-up water to flow from inlet line 38 into loop 76. As shown in FIG. 2, valve 72 facilitates the flow of make-up water from inlet line 38 into loop 76, thereby allowing heated water to flow from loop 76 to outlet line 40.

As shown in FIG. 1, inlet line 38 communicates directly with make-up pipe 28. It should be understood however that line 38 could be arranged to communicate indirectly with pipe 28 by being connected directly to lower tank portion 16. Similarly, outlet line 40 is shown in communication directly with delivery pipe 30. It should be understood here too that line 40 could be arranged to communicate indirectly with pipe 30 through upper tank portion 14.

Also as shown in FIGS. 1 and 2, water storage zone 62 includes water storage line 64 formed as a coil. Obviously other storage vessels could be provided, for example in the form of lines having other shapes, auxiliary tanks having low-velocity inlet headers, etc.

Further, valve 72 is shown in FIGS. 1 and 2 as a three-way valve. As is well known in the art, other valving arrangements could be provided. For example, two two-way valves could be substituted for three-way valve 72.

It will be apparent to those skilled in the art that the invention disclosed herein provides a simple, efficient, easily constructed and installed batch-type water heating apparatus for use with a conventional water heater. The apparatus is readily adaptable for production either as an equipment package for the new construction and replacement markets, or as an aftermarket package for on-site connection to an exising water heater.

It should be understood that while a preferred embodiment of this invention has been shown and described, it is to be considered as illustrative and may be modified by those skilled in the art. It is intended that the claims herein cover all such modifications as may fall within the spirit and scope of the invention.

What is claimed is:

1. Batch-type water heating apparatus comprising a water heater including a water storage tank having an upper portion communicating with a hot water delivery pipe and a lower portion communicating with a make-up water pipe; a water circulating loop including water circulating means, a heat exchanger in which water is heated, a water storage zone, and flow control means sensitive to the water temperature in said loop; and means associated with said flow control means for commmunicating said loop with said upper tank portion and for communicating said lower tank portion with said loop; said flow control means being operable to divert heated water from said loop to said upper tank portion and to divert make-up water from said lower tank portion to said loop when the sensed water temperature in said loop exceeds a predetermined value, and said flow control means being operable to facilitate the circulation of water around said loop when the sensed water temperature in said loop is below said predetermined value.

2. Batch-type water heating apparatus comprising a water heater including a water storage tank; a water circulating loop including a pump, a heat exchanger, and a water storage zone; means establishing fluid communication from the outlet of said zone to the upper portion of said tank and establishing fluid communication from the lower portion of said tank to said loop; and flow control means sensitive to the water temperature in said loop, said flow control means preventing said fluid communication when the sensed water temperature in said loop is below a predetermined value and allowing said fluid communication when the sensed water temperature in said loop exceeds a predetermined value.

3. The batch-type water heating apparatus of claim 1, said flow control means including valve means; and said communicating means including a heated water outlet line communicating said loop with said upper tank portion and including a make-up water inlet line communicating said lower tank portion with said loop; said flow control means being operable to position said valve means to direct the flow of heated water from said loop through said outlet line to said upper tank portion and to direct the flow of make-up water from said lower tank portion through said inlet line to said loop when the sensed temperature exceeds said predetermined value, and said flow control means being operable to position said valve means to direct the flow of water around said loop when the sensed temperature is below said predetermined value.

4. The batch-type water heating apparatus of claim 3, said valve means blocking one of said lines when positioned to direct the flow of water around said loop.

5. The batch-type water heating apparatus of claim 2, said flow control means being sensitive to the water temperature in said zone.

6. The batch-type water heating apparatus of claim 2, further comprising a heat pump, said heat exchanger being the condenser of said heat pump.

7. The batch-type water heating apparatus of claim 3, further comprising a heat pump, said heat exchanger being the condenser of said heat pump.

8. The batch-type water heating apparatus of claim 3, said flow control means including means sensing the water temperature in said storage zone.

9. The batch-type water heating apparatus of claim 2, said zone including a coiled water storage line with a diffuser at its inlet.

10. The batch-type water heating apparatus of claim 4, further comprising a heat pump, said heat exchanger being the condenser of said heat pump.

11. The batch-type water heating apparatus of claim 2, further comprising a heat pump, said heat exchanger being the condenser of said heat pump.

12. The batch-type water heating apparatus of claim 6, said tank including a tank thermostat, said apparatus further comprising means responsive to said tank thermostat for actuating said water circulating means, said heat pump and said flow control means.

13. The batch-type water heating apparatus of claim 7, said tank including a tank thermostat, and said apparatus further comprising means responsive to said tank thermostat for actuating said water circulating means, said heat pump and said flow control means.

14. The batch-type water heating apparatus of claim 8, further comprising a heat pump, said heat exchanger being the condenser of said heat pump.

15. The batch-type water heating apparatus of claim 9, further comprising a heat pump, said heat exchanger being the condenser of said heat pump.

16. The batch-type water heating apparatus of claim 10, said tank including a tank thermostat, and said apparatus further comprising means responsive to said tank thermostat for actuating said water circulating means, said heat pump and said flow control means.

17. The batch-type water heating apparatus of claim 11, said tank including a tank thermostat, and said apparatus further comprising means responsive to said tank thermostat for actuating said water circulating means, said heat pump and said flow control means.

18. The batch-type water heating apparatus of claim 4, said one line being said outlet line.

19. The batch-type water heating apparatus of claim 4, said one line being said inlet line.

20. The batch-type water heating apparatus of claim 14, said tank including a tank thermostat, and said apparatus further comprising means responsive to said tank thermostat for actuating said water circulating means, said heat pump and said flow control means.

21. The batch-type water heating apparatus of claim 15, said tank including a tank thermostat, and said apparatus further comprising means responsive to said tank thermostat for actuating said water circulating means, said heat pump and said flow control means.

* * * * *